US011624196B2

(12) United States Patent
Chevis et al.

(10) Patent No.: US 11,624,196 B2
(45) Date of Patent: Apr. 11, 2023

(54) CONNECTOR END FITTING FOR AN INTEGRATED CONSTRUCTION SYSTEM

(71) Applicant: Apache Industrial Services, Inc., Houston, TX (US)

(72) Inventors: Kenneth M. Chevis, Metarie, LA (US); Jonathon Daub, Houston, TX (US)

(73) Assignee: Apache Industrial Services, INC, Houston, TX (US)

( * ) Notice: Subject to any disclaimer, the term of this patent is extended or adjusted under 35 U.S.C. 154(b) by 59 days.

(21) Appl. No.: 16/791,811

(22) Filed: Feb. 14, 2020

(65) Prior Publication Data

US 2020/0190833 A1 Jun. 18, 2020

Related U.S. Application Data

(63) Continuation-in-part of application No. 16/222,825, filed on Dec. 17, 2018, now Pat. No. 11,306,492, (Continued)

(51) Int. Cl.
*E04G 11/48* (2006.01)

(52) U.S. Cl.
CPC ..... *E04G 11/483* (2013.01)

(58) Field of Classification Search
CPC ..... E04G 11/483; E04F 15/024; E04F 15/02458; E04F 15/02452; E04F 15/02464; E04F 15/02447; A63H 33/04
(Continued)

(56) References Cited

U.S. PATENT DOCUMENTS 559,931 A 5/1896 Campbell
1,890,336 A 12/1932 Nodine
(Continued)

FOREIGN PATENT DOCUMENTS

BE 1006369 A6 8/1994
CA 2712330 A1 7/2011
(Continued)

OTHER PUBLICATIONS

PCT International Search Report and Written Opinion; PCT/US2021/020113; dated Aug. 2021.
(Continued)

*Primary Examiner* — Beth A Stephan
(74) *Attorney, Agent, or Firm* — Pramudji Law Group PLLC; Ari Pramudji

(57) ABSTRACT

End fittings may be designed so that they connect to each other in more than two configurations. A first end fitting may be connected to an adjoining end fitting, removed, rotated ninety degrees and reconnected with the adjoining end fitting without jeopardizing stability of the position of each end fitting relative to the other. The first end fitting may be connected to the adjoining end fitting, removed, rotated an additional ninety degrees and reconnected with the adjoining end fitting without jeopardizing stability of the position of each end fitting relative to the other. The first end fitting may be connected to an adjoining end fitting, removed, rotated a yet further ninety degrees and reconnected with the adjoining end fitting without jeopardizing stability of the position of each end fitting relative to the other.

20 Claims, 6 Drawing Sheets

Related U.S. Application Data which is a continuation-in-part of application No. 15/971,620, filed on May 4, 2018, which is a continuation-in-part of application No. 15/910,698, filed on Mar. 2, 2018, now Pat. No. 10,415,262, which is a continuation-in-part of application No. 15/845,962, filed on Dec. 18, 2017, now Pat. No. 10,465,399, which is a continuation-in-part of application No. 15/630,923, filed on Jun. 22, 2017, now Pat. No. 10,472,823.

(60) Provisional application No. 62/471,173, filed on Mar. 14, 2017, provisional application No. 62/354,325, filed on Jun. 24, 2016.

(58) Field of Classification Search
USPC ..... 52/126.6, 127.2, 439, 261, 263
See application file for complete search history.

(56) References Cited

U.S. PATENT DOCUMENTS 1,890,386 A 12/1932 Kingston
1,919,405 A 7/1933 Wilson
1,974,752 A 9/1934 Roberg
2,261,907 A 11/1941 Uecker et al.
2,382,201 A 8/1945 Burke et al.
2,479,962 A 8/1949 Paulson
2,573,806 A 10/1951 Yoshimoto
2,970,677 A 2/1961 Springs, Jr. et al.
3,018,898 A 1/1962 Frazelle
3,168,772 A 2/1965 Williams
3,222,829 A 12/1965 Bening
3,288,427 A 11/1966 Pluckebaum
3,318,057 A * 5/1967 Norsworthy ..... E04F 15/02482 52/126.6
3,392,801 A 7/1968 Gethmann
3,420,012 A * 1/1969 Custer ..... E04F 15/02452 52/126.6
3,462,110 A 8/1969 Cheslock
3,486,287 A 12/1969 Guillon
3,491,852 A 1/1970 Leist
3,493,208 A 2/1970 Sato
3,533,857 A 10/1970 Vecchiarelli
3,550,723 A 12/1970 Gentry et al.
3,559,357 A 2/1971 Lowe
3,578,060 A 5/1971 Spencer
3,601,356 A 8/1971 Yurick
3,684,058 A 8/1972 Brown
3,696,578 A * 10/1972 Swensen ..... E04F 15/02417 52/789.1
3,815,858 A 6/1974 Mocny et al.
3,822,850 A 7/1974 Elias
3,900,179 A 8/1975 Mocny et al.
4,030,694 A 6/1977 Schimmel
4,032,100 A 6/1977 Kahn
4,033,081 A 7/1977 Perkins, Jr.
4,036,466 A 7/1977 Van Meter
4,102,096 A 7/1978 Cody
4,106,256 A 8/1978 Cody
4,133,433 A 1/1979 Wolf
4,158,452 A 6/1979 Gates
4,162,682 A 7/1979 Miller et al.
4,163,537 A 8/1979 Mourgue
4,194,338 A 3/1980 Trafton
4,372,425 A 2/1983 Murphy
4,458,461 A 7/1984 Holley
4,470,574 A 9/1984 Jackson
4,473,209 A 9/1984 Gallis et al.
4,493,172 A 1/1985 Jones
4,516,372 A 5/1985 Grutsch
4,558,544 A * 12/1985 Albrecht ..... E04F 15/0247 52/126.1
4,582,001 A 4/1986 Leikarts
4,587,786 A 5/1986 Woods
4,619,433 A 10/1986 Maier
4,685,264 A 8/1987 Landis
4,742,985 A 5/1988 Mathis
4,761,847 A 8/1988 Savage et al.
4,787,183 A 11/1988 Johnston
4,805,365 A 2/1989 Bastian
4,813,196 A 3/1989 Bokelund et al.
4,821,844 A 4/1989 Huffman et al.
4,831,791 A 5/1989 Ball
4,880,195 A 11/1989 Lepley
4,919,268 A * 4/1990 Young ..... A63H 33/088 206/509
5,078,360 A 1/1992 Spera
5,125,617 A 6/1992 Miller
5,150,557 A 9/1992 Gregory
5,192,145 A 3/1993 Rixen et al.
5,219,473 A 6/1993 Sandwith
5,228,258 A 7/1993 Onoda et al.
5,240,089 A 8/1993 Spera
5,307,601 A 5/1994 Mccracken
5,367,852 A 11/1994 Masuda
5,379,566 A 1/1995 Schwörer
5,385,323 A 1/1995 Garelick
5,447,249 A * 9/1995 Vickers ..... B65D 81/361 206/511
5,509,635 A 4/1996 Jaruzel
5,549,176 A 8/1996 Hawkins
5,575,938 A 11/1996 Ono
5,641,036 A 6/1997 Maxwell
5,729,948 A 3/1998 Levy et al.
5,746,535 A 5/1998 Kohler
5,791,096 A 8/1998 Chen
5,941,486 A 8/1999 Riblet
5,979,119 A 11/1999 Trafton
6,059,258 A 5/2000 Jackson
6,106,186 A 8/2000 Taipale et al.
6,161,359 A 12/2000 Ono
6,186,856 B1 * 2/2001 Chen ..... A63H 33/04 446/117
6,321,501 B1 11/2001 Ignash
6,422,345 B1 7/2002 Schworer
6,439,344 B1 8/2002 Cole
6,450,291 B1 9/2002 Ono
6,520,471 B2 * 2/2003 Jones ..... E01C 5/223 248/346.3
6,554,235 B1 4/2003 Fortier
6,575,652 B2 6/2003 Krauss
6,712,543 B1 3/2004 Schmalzhofer
6,751,914 B2 6/2004 Zeh et al.
6,872,117 B1 3/2005 Chen
6,913,422 B2 7/2005 Rogers
6,953,106 B2 10/2005 Weston et al.
7,032,268 B2 4/2006 Jackson
7,096,641 B2 8/2006 Birnbaum et al.
7,120,664 B2 10/2006 Sawa et al.
7,165,361 B2 1/2007 Vanagan
7,178,765 B2 2/2007 Huang
7,249,624 B2 7/2007 Zeh et al.
7,530,540 B2 5/2009 Long et al.
7,918,059 B2 4/2011 Repasky
7,950,199 B2 5/2011 Newhouse et al.
8,083,192 B2 12/2011 Wells et al.
8,136,633 B2 3/2012 Rogers
8,302,356 B2 * 11/2012 Knight, III ..... E04F 15/02452 52/263
8,403,280 B2 3/2013 Halverson et al.
8,418,425 B1 4/2013 Santini
8,635,820 B2 1/2014 Lafferty, III et al.
8,827,587 B2 9/2014 Didehvar
8,869,477 B2 10/2014 Ha et al.
9,074,379 B2 7/2015 Ciuperca
9,153,860 B2 10/2015 Tserodze et al.
9,249,565 B2 2/2016 Merrifield
9,388,561 B2 7/2016 Johnson et al.
9,546,489 B2 1/2017 Rosati
9,556,624 B1 1/2017 Law
9,587,298 B2 3/2017 Lin et al.
9,719,267 B2 8/2017 Rogers
10,266,993 B2 * 4/2019 Szekely ..... E01C 5/20

(56) References Cited

U.S. PATENT DOCUMENTS

| | | | | |
|---|---|---|---|---|
| 10,415,262 | B2 | 11/2019 | Chevis | |
| 10,465,399 | B2 | 11/2019 | Chevis | |
| 10,472,823 | B2 | 11/2019 | Chevis | |
| 10,641,302 | B1 | 5/2020 | Huffman et al. | |
| 10,844,613 | B2 * | 11/2020 | Repasky | E04F 15/02464 |
| 11,203,470 | B2 * | 12/2021 | Ezra | B65D 51/24 |
| 2002/0092961 | A1 | 7/2002 | Gallis | |
| 2002/0185335 | A1 | 12/2002 | Verdyk | |
| 2003/0194265 | A1 | 10/2003 | Krauss | |
| 2004/0055249 | A1 | 3/2004 | Kennedy | |
| 2004/0200172 | A1 | 10/2004 | Beck et al. | |
| 2004/0237437 | A1 | 12/2004 | Hur | |
| 2005/0045785 | A1 | 3/2005 | Cohen | |
| 2005/0166483 | A1 * | 8/2005 | Mead | E04F 15/02452 52/126.7 |
| 2005/0217040 | A1 | 10/2005 | Jackson | |
| 2006/0011802 | A1 | 1/2006 | Di Cesare | |
| 2006/0027729 | A1 | 2/2006 | McCracken | |
| 2006/0042179 | A1 | 3/2006 | Vanagan | |
| 2006/0175130 | A1 | 8/2006 | Riley | |
| 2007/0021048 | A1 | 1/2007 | Henning | |
| 2007/0045048 | A1 | 3/2007 | Wyse | |
| 2007/0056799 | A1 | 3/2007 | Leidner | |
| 2008/0017783 | A1 | 1/2008 | Vanagan | |
| 2008/0105172 | A1 * | 5/2008 | Repasky | E04F 15/02183 108/144.11 |
| 2008/0141601 | A1 * | 6/2008 | Mead | E04F 15/02452 52/263 |
| 2008/0210725 | A1 | 9/2008 | Birtwisle et al. | |
| 2008/0244006 | A1 | 10/2008 | Weisner et al. | |
| 2008/0244996 | A1 | 10/2008 | Gillespie et al. | |
| 2009/0188189 | A1 | 8/2009 | Repasky | |
| 2009/0212195 | A1 | 8/2009 | Arocena Bergareche et al. | |
| 2009/0301815 | A1 | 12/2009 | Rogers | |
| 2010/0000822 | A1 | 1/2010 | Wall | |
| 2010/0005735 | A1 | 1/2010 | Gillespie et al. | |
| 2010/0122872 | A1 | 5/2010 | Korevaar | |
| 2010/0224447 | A1 | 9/2010 | Rogers | |
| 2011/0011018 | A1 | 1/2011 | Johnson et al. | |
| 2011/0101587 | A1 | 5/2011 | Quintania et al. | |
| 2011/0138723 | A1 * | 6/2011 | Repasky | E04F 15/02183 52/309.1 |
| 2012/0025058 | A1 | 2/2012 | Floreani et al. | |
| 2012/0112376 | A1 | 5/2012 | Khoo | |
| 2013/0015185 | A1 * | 1/2013 | Leal | B65D 81/361 220/212 |
| 2013/0036688 | A1 | 2/2013 | Gosain | |
| 2013/0043095 | A1 | 2/2013 | Thacker | |
| 2013/0161462 | A1 | 6/2013 | Haddock | |
| 2014/0020982 | A1 | 1/2014 | Hayman et al. | |
| 2014/0021424 | A1 | 1/2014 | Ramskov | |
| 2014/0086669 | A1 | 3/2014 | Rogers | |
| 2014/0228060 | A1 | 8/2014 | Abhyanker | |
| 2014/0339019 | A1 | 11/2014 | Hulett et al. | |
| 2014/0361144 | A1 | 12/2014 | Mcgahan | |
| 2015/0157885 | A1 | 6/2015 | Liu | |
| 2015/0211242 | A1 | 7/2015 | Rosati | |
| 2015/0337548 | A1 | 11/2015 | Ciuperca | |
| 2016/0002936 | A1 | 1/2016 | Cox | |
| 2016/0102462 | A1 | 4/2016 | Griffiths et al. | |
| 2016/0244984 | A1 | 8/2016 | Hollmann | |
| 2016/0281376 | A1 | 9/2016 | Ward | |
| 2016/0305459 | A1 | 10/2016 | Park et al. | |
| 2017/0254099 | A1 | 9/2017 | Grumberg et al. | |
| 2017/0350141 | A1 * | 12/2017 | Kugler | E04F 15/0247 |
| 2017/0370099 | A1 | 12/2017 | Chevis | |
| 2018/0099233 | A1 * | 4/2018 | Peiler | A63H 33/086 |
| 2020/0011074 | A1 | 1/2020 | Chevis | |
| 2021/0180344 | A1 | 6/2021 | McCracken | |

FOREIGN PATENT DOCUMENTS

| | | | |
|---|---|---|---|
| CH | 506685 | A | 4/1971 |
| CN | 1188175 | A | 7/1998 |
| CN | 201835529 | U | 5/2011 |
| CN | 103899083 | A | 7/2014 |
| CN | 203878831 | U | 10/2014 |
| CN | 204386134 | U | 6/2015 |
| CN | 107100358 | A | 8/2017 |
| CN | 207686282 | U | 8/2018 |
| CN | 110700585 | A | 1/2020 |
| CN | 210086830 | U | 2/2020 |
| DE | 9305194 | U1 | 8/1993 |
| DE | 9309950 | U1 | 9/1993 |
| DE | 4328105 | C1 | 9/1994 |
| DE | 19807860 | A1 | 9/1999 |
| DE | 29912555 | U1 | 10/1999 |
| DE | 10121957 | A1 | 11/2002 |
| DE | 202009010716 | U1 | 11/2009 |
| EP | 0062420 | A1 | 10/1982 |
| EP | 0369108 | A2 | 5/1990 |
| EP | 0375969 | A1 | 7/1990 |
| EP | 0408209 | A2 | 1/1991 |
| EP | 0729536 | A1 | 9/1996 |
| EP | 1498571 | A1 | 1/2005 |
| EP | 1544379 | A2 | 6/2005 |
| EP | 2462296 | A1 | 6/2012 |
| EP | 2937056 | A1 | 10/2015 |
| FR | 926917 | A | 10/1947 |
| FR | 2527254 | A1 | 11/1983 |
| FR | 2593843 | A1 | 8/1987 |
| GB | 838828 | A | 6/1960 |
| GB | 877463 | A | 9/1961 |
| GB | 1465950 | A | 3/1977 |
| GB | 2133826 | A | 8/1984 |
| GB | 2145761 | A | 4/1985 |
| GB | 2215374 | A | 9/1989 |
| GB | 2398848 | A | 9/2004 |
| GB | 2592433 | A | 9/2021 |
| JP | H07-279411 | A | 10/1995 |
| JP | H10-46806 | A | 2/1998 |
| JP | 2002256700 | A | 9/2002 |
| JP | 2004156416 | A | 6/2004 |
| JP | 2009127315 | A | 6/2009 |
| JP | 2016532026 | A | 10/2016 |
| KR | 920008222 | Y1 | 11/1992 |
| KR | 0134600 | Y1 | 2/1999 |
| KR | 20030095163 | A | 12/2003 |
| KR | 200372312 | Y1 | 1/2005 |
| KR | 200381397 | Y1 | 4/2005 |
| KR | 20060078341 | A | 7/2006 |
| KR | 10-0682310 | B1 | 2/2007 |
| KR | 20110077096 | A | 7/2011 |
| KR | 101194682 | B1 | 10/2012 |
| KR | 20-0463949 | Y1 | 12/2012 |
| KR | 200469990 | Y1 | 11/2013 |
| KR | 101335478 | B1 | 12/2013 |
| KR | 20150116373 | A | 10/2015 |
| KR | 20170128688 | A | 11/2017 |
| KR | 20190115612 | A | 10/2019 |
| KR | 102166828 | B1 | 10/2020 |
| KR | 102180857 | B1 | 11/2020 |
| KR | 20210043807 | A | 4/2021 |
| WO | 1998007935 | A1 | 2/1998 |
| WO | 2002003116 | A1 | 8/2002 |
| WO | 2006135223 | A1 | 12/2006 |
| WO | 2007043897 | A2 | 4/2007 |
| WO | 2010054836 | A2 | 5/2010 |
| WO | 2012096639 | A1 | 7/2012 |
| WO | 2017223504 | A1 | 12/2017 |
| WO | 2018143534 | A1 | 8/2018 |

OTHER PUBLICATIONS

PCT International Search Report and Written Opinion; PCT/US2018/066256; dated Apr. 11, 2019.

PCT International Search Report and Written Opinion; PCT/US2017/039097; dated Jun. 23, 2017.

* cited by examiner

CONNECTOR END FITTING FOR AN INTEGRATED CONSTRUCTION SYSTEM

CROSS-REFERENCE TO RELATED APPLICATIONS

This application is a continuation-in-part of U.S. patent application Ser. No. 16/222,825, filed Dec. 17, 2018, which is a continuation-in-part of U.S. patent application Ser. No. 15/971,620, filed May 4, 2018, which is a continuation-in-part of U.S. patent application Ser. No. 15/910,698, filed Mar. 2, 2018 and now U.S. patent Ser. No. 10/415,262, which is a continuation-in-part of U.S. patent application Ser. No. 15/845,962, filed Dec. 18, 2017 and now U.S. patent Ser. No. 10/465,399, which is a continuation-in-part of U.S. patent application Ser. No. 15/630,923, filed Jun. 22, 2017 and now U.S. patent Ser. No. 10/472,823, which claims the benefit of U.S. Provisional Application No. 62/471,173, filed Mar. 14, 2017, and U.S. Provisional Application No. 62/354,325, filed Jun. 24, 2016, all of which are incorporated herein by reference.

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

There are two types of concrete construction that require some form of formwork: vertical formwork and shoring. Vertical formwork provides the ability to form structures that hold vertical loads. Shoring provides the ability to form structures that hold horizontal loads. Vertical structures like walls, columns and foundations require formwork, and horizontal structures like slabs, beams and girders require shoring to cast them into place as an elevated structural component. Examples where shoring provides horizontal concrete members include: slabs, horizontal concrete girders, cross-t's under highways, etc.

Many companies in existence today have developed specific independent formwork systems and independent shoring systems. They generally carry a sizable inventory of several different types that are both rented and sold to contractors who build concrete structures.

The applications of formwork and shoring are unlimited given the wide range of project types in both the industrial and commercial construction markets. From high-rise buildings, to the construction of an industrial facility, formwork and shoring are used to help contractors cast foundations, columns, walls, elevated slabs and elevated beams in an enormous variety of shapes and uses. Chances are that all of the buildings in which people live and work have some sort of poured in-place concrete that was casted using a formwork system.

Older generation systems required formwork and shoring providers to have significantly large inventories of parts in order to make up the variety of configurations necessary. Those systems consisted of endless amounts of components used by a building contractor. Along with the large amount of inventory items, the assembly efficiency for those systems was often on the low side, as compared to systems in use today. Due to the large amount of pieces, it was common for many of these items to be lost during the construction process.

In either vertical formwork or shoring, it is sometimes becomes necessary to utilize columns for bearing a load. The columns may be monolithic or they may be multiple columns connected end-to-end to one-another. In end-to-end connections, the columns may experience slippage, which may be catastrophic. Therefore, it may be helpful for the columns to be connected to each other so that they do not slip, thereby avoiding catastrophe.

SUMMARY

Briefly, particular implementations of the claimed subject matter may relate to formwork structural support members.

In an implementation, an end fitting for a structural support member may include a substrate having a first substantially planar surface and a first interlock section on the substrate. The first interlock section may include a first projection projecting from the first substantially planar surface. The first projection may be at least partially defined by a first edge, a second edge and a third edge coupled together in a right triangle configuration.

In a further implementation, a structural support member end fitting system may include a first end fitting and a second for a structural support member. The first and the second end fitting may each include a substrate having a first planar surface and a first interlock section on the substrate. The first interlock section may include a first projection projecting from the first substantially planar surface. The first interlock section may be at least partially defined by a first edge, a second edge and a third edge coupled together in a right-triangle configuration.

In other implementations, a method of connecting end fittings may include connecting a first interlock section of a first end fitting to a second interlock section of a second end fitting, disconnecting the first interlock section from the second interlock section of the second end fitting, rotating the first end fitting a first ninety degrees in a first direction, and reconnecting the first interlock section of the first end fitting to the second interlock section of the second end fitting. Each of the first and second end fittings may have a first plurality of projections and recesses.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various techniques described herein.

DETAILED DESCRIPTION

Integrated construction system components include support members, i.e., posts, having ends that may be connected in a butt-end connection. In a butt-end connection, it may be helpful to add an end fitting at the end of the post. An end fitting may increase the surface area of contact between butt-ends of the post. Thus, an end fitting of an end of a first post may abut an end fitting of an end of an adjoining post.

End fittings on the butt ends of posts may be substantially flat. Substantially flat end fittings include a risk of lateral displacement of one end fitting relative to an adjoining end fitting. Projections and recesses such as ridges, corrugations, valleys, indentations, etc. may be added to each of the end fittings to prevent lateral movement of one end fitting relative to an adjoining end fitting, which may help to ensure stabilization of the position of each end fitting relative to the other.

To further stabilize the end fittings relative to each other, the projections and recesses may be configured so that they have a mated relationship. For example, the projections and recesses of the end fittings may be configured such that they can properly abut each other in only one position. Changing a position of one end fitting relative to the other may be prevented by the design of each of the end fittings. Previous designs of end fittings were limited to one or, at most, two positions at which end fittings could connect to each other.

Presently disclosed implementations of end fittings may be designed so that they connect to each other in more than two configurations. For example, in some implementations, a first end fitting may be connected to an adjoining end fitting, removed, rotated ninety degrees and reconnected with the adjoining end fitting without jeopardizing stability of the position of each end fitting relative to the other. In the same implementation, the first end fitting may be connected to the adjoining end fitting, removed, rotated an additional ninety degrees and reconnected with the adjoining end fitting without jeopardizing stability of the position of each end fitting relative to the other. In yet the same implementation, the first end fitting may be connected to an adjoining end fitting, removed, rotated a yet further ninety degrees and reconnected with the adjoining end fitting without jeopardizing stability of the position of each end fitting relative to the other.

Figure 1:
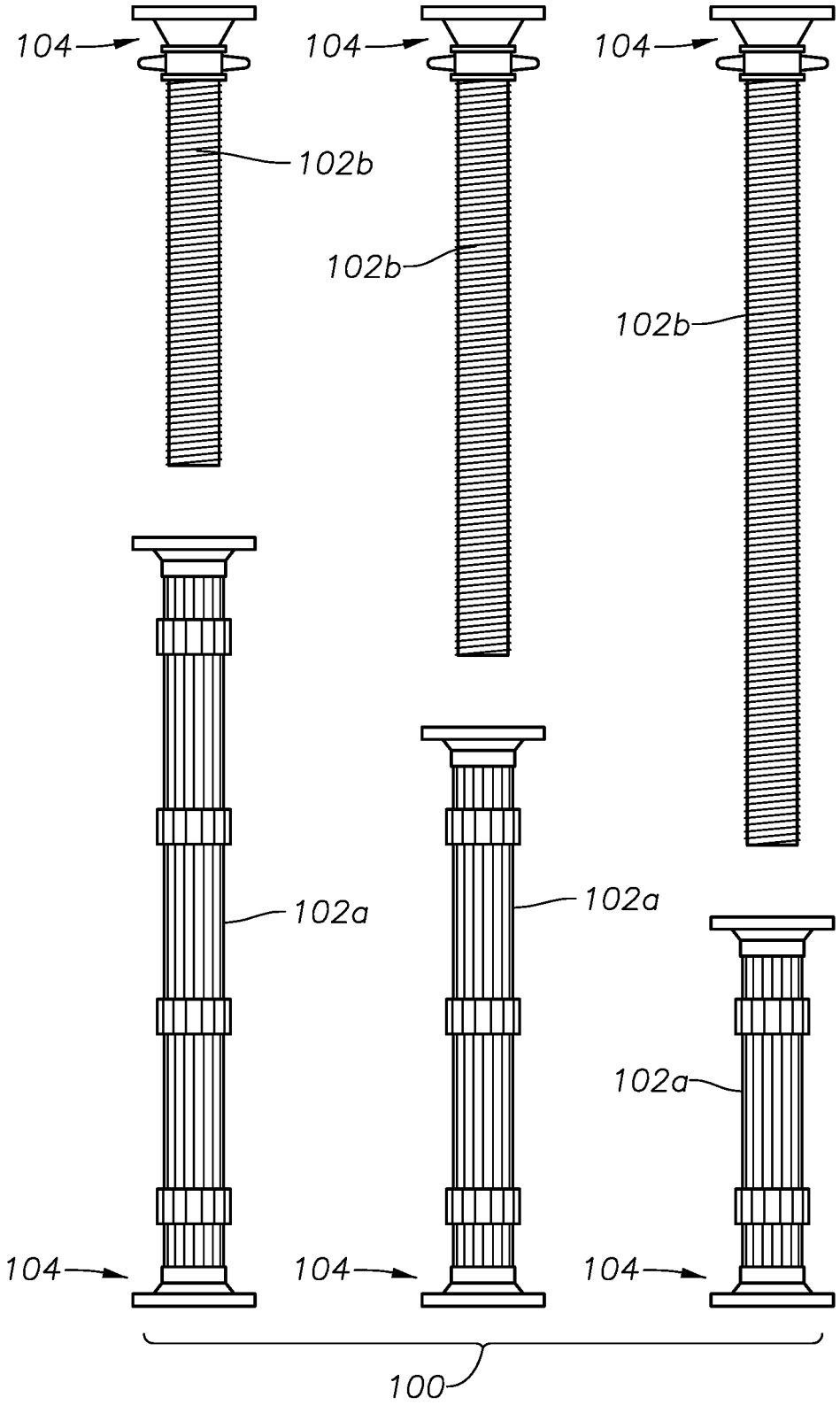
FIG. 1 illustrates a plurality of columns for a formwork/shoring system using components in accordance with implementations of various techniques described herein.

An implementation 100 of a post for formwork/shoring is illustrated in FIG. 1, which may include a post 102*a* and an adjustable screw leg 102*b*. The adjustable screw leg 102*b* may be disposed within the post 102*a*. The post 102*a* and the adjustable screw leg 102*b* may each include threaded surfaces that are engageable with each other for extension and retraction of the adjustable screw leg 102*b* within the post 102*a*.

Each post 102*a* and each adjustable screw leg 102*b* may include an end fitting 104, i.e., a bracket. In some implementations, the post 102*a* is implemented without an adjustable screw leg. Thus, an end fitting 104 may be on opposing ends of a single post or on an end of a post 102*a* and on an end of the adjustable screw leg 102*b* within the post.

The adjustable screw leg 102*b* may be provided for adjustment of the length of the implementation. For example, a length can be adjusted by rotating the adjustable screw leg 102*b* around a longitudinal axis of the adjustable screw leg 102*b*. Thus, an implementation may be used in environments that require different lengths. The adjustable screw leg 102*b* may also be provided to tighten the implementation in place or to loosen the implementation from place within a structure.

Figure 2:
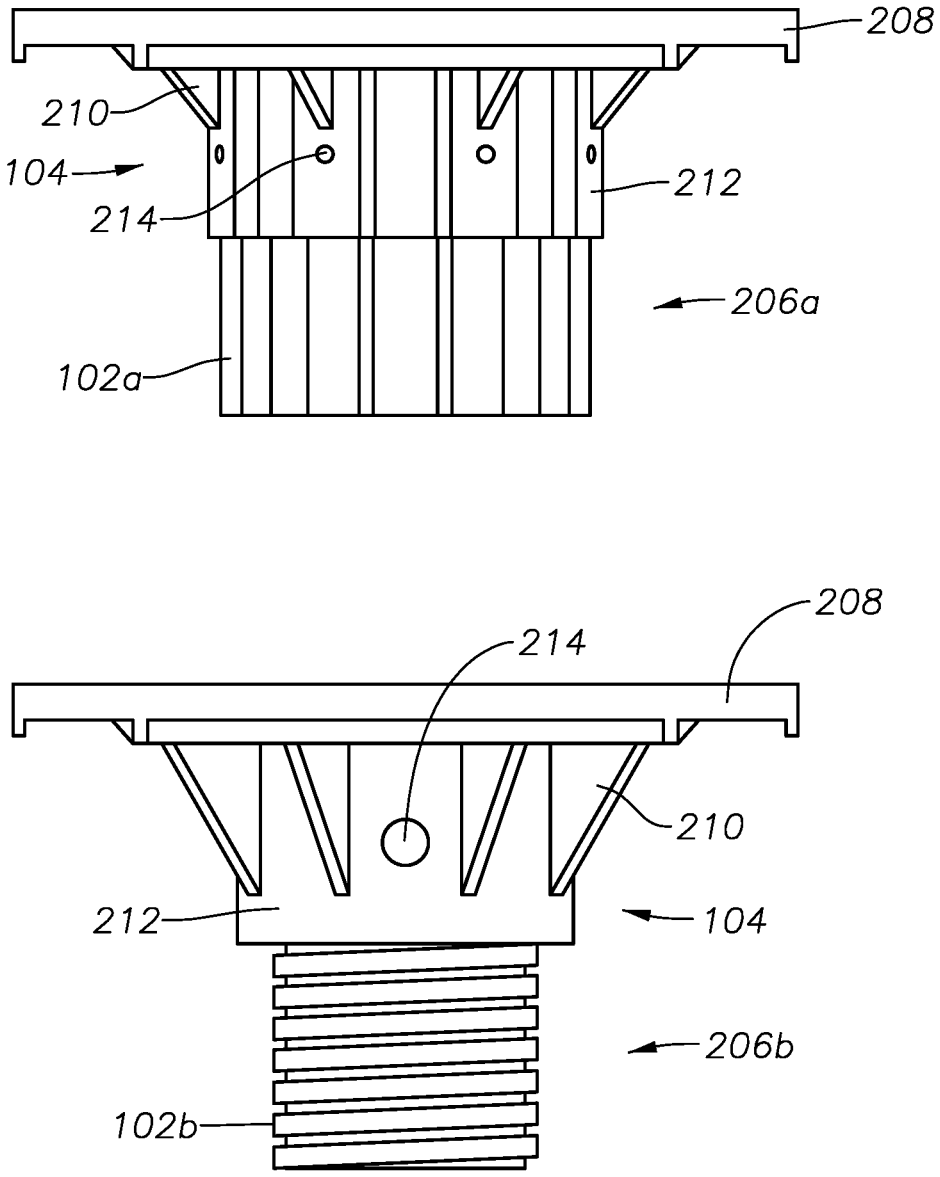
FIG. 2 illustrates an end fitting attached to an end region of at least one of the columns of FIG. 1.

As illustrated in FIG. 2, the end fitting 104 is at an end region 206*a* of the post 102*a* and/or at an end region 206*b* of the adjustable screw leg 102*b*. The end fitting 104 may include a substrate 208, reinforcing webs 210 and a sleeve 212. The sleeve 212 may be cylindrical and may engage the end region 206*a* of the post 102*a* or adjustable leg 102*b* in a substantially coaxial arrangement. The sleeve 212 is not limited to being cylindrical. The sleeve 212 may be rectangular, triangular, polygonal, oval, etc. The sleeve 212 may have the same shape as a cross section of the end region 206*a* and/or 206*b* of the post 102*a* and/or adjustable screw leg 102*b*, respectively; however, it is not necessary that the sleeve 212 have the same shape as a cross-section of the end of the post 102*a* and/or 102*b*.

A threaded through-hole 214 may be included in the sleeve 212. A threaded screw (not shown) or other fastener known to a person of ordinary skill, such as a clamp or cotter pin, may engage the threaded through-hole 214 to tighten the sleeve 212 to the end region 206*a* and/or 206*b* of the post 102*a* and/or adjustable screw leg 102*b*, respectively.

Figure 3:
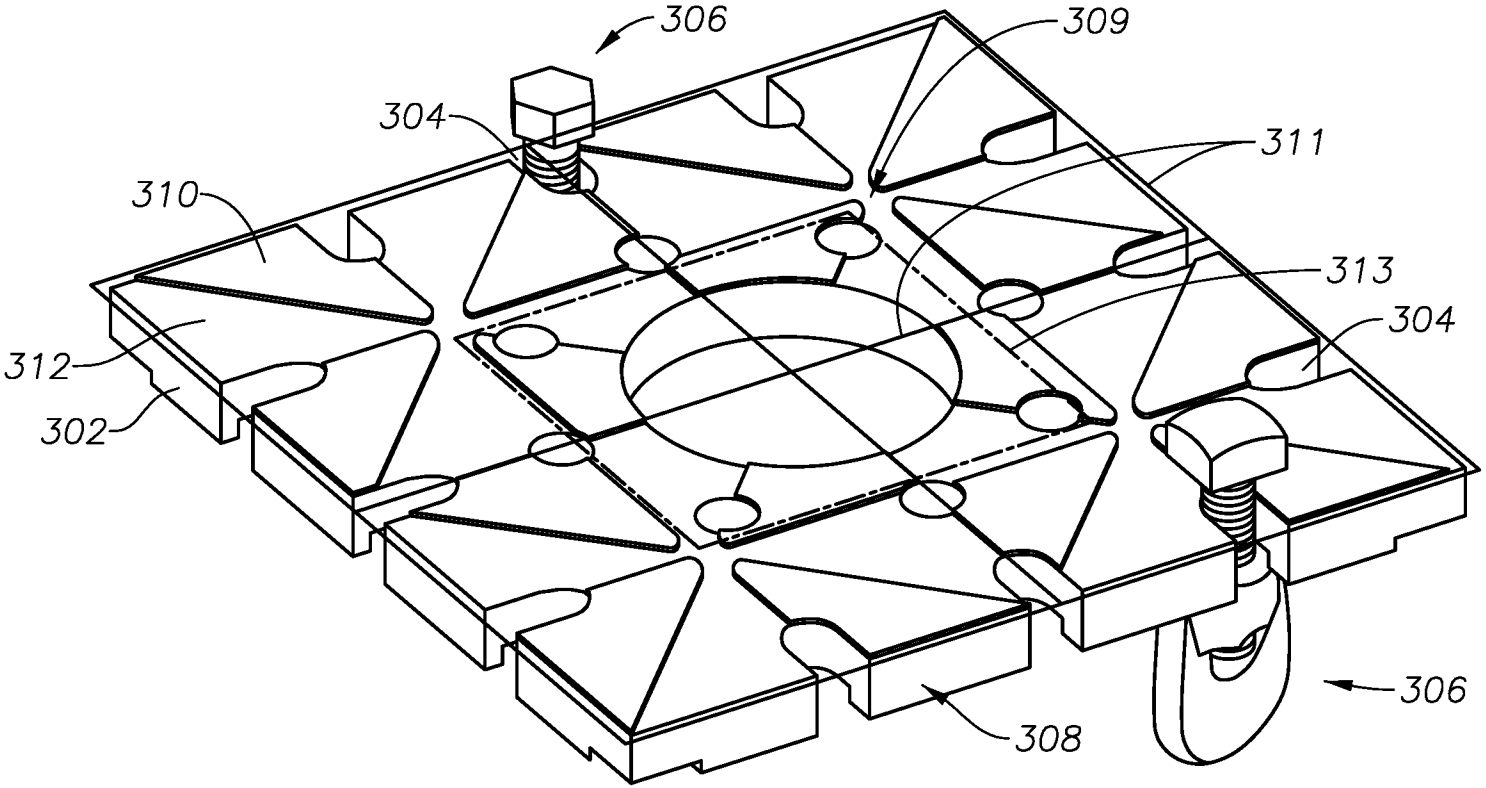
FIG. 3 illustrates an end fitting of FIG. 2.

FIG. 3 illustrates the substrate 208 of the end fitting 104. The substrate may be a substantially flat surface and may include a rectangular, circular, oval, asymmetric, or other shaped perimeter 302. Edge recesses 304 may be included in the perimeter 302. Fasteners 306 may engage the edge recesses 304. The fasteners 306 may be bolts, screws, clamps or other fasteners known to a person having ordinary skill in the art. The function of the fastener 306 will be explained in more detail below.

The substrate 208 may include at least one interlock section 308. Each interlock section 308 may include projections 310 and/or recesses 312. For example, the implementation of the substrate 208 illustrated in FIG. 3 includes five interlock sections. A separate interlock section 308 is at each of the four corners of the substrate 208 and a fifth interlock section 309 is at the center of the substrate 208 and is created by each interior corner of the four corner interlock sections 308.

As illustrated in FIG. 3, each of the corner interlock sections 308 is outlined by a solid line 311. The fifth interlock section 309 is outlined by a dash-dot-dash line 313. The substrate 208 is not limited to five interlock sections. The substrate 208 may include a single interlock section, five interlock sections, twenty interlock sections, etc.

Figure 4:
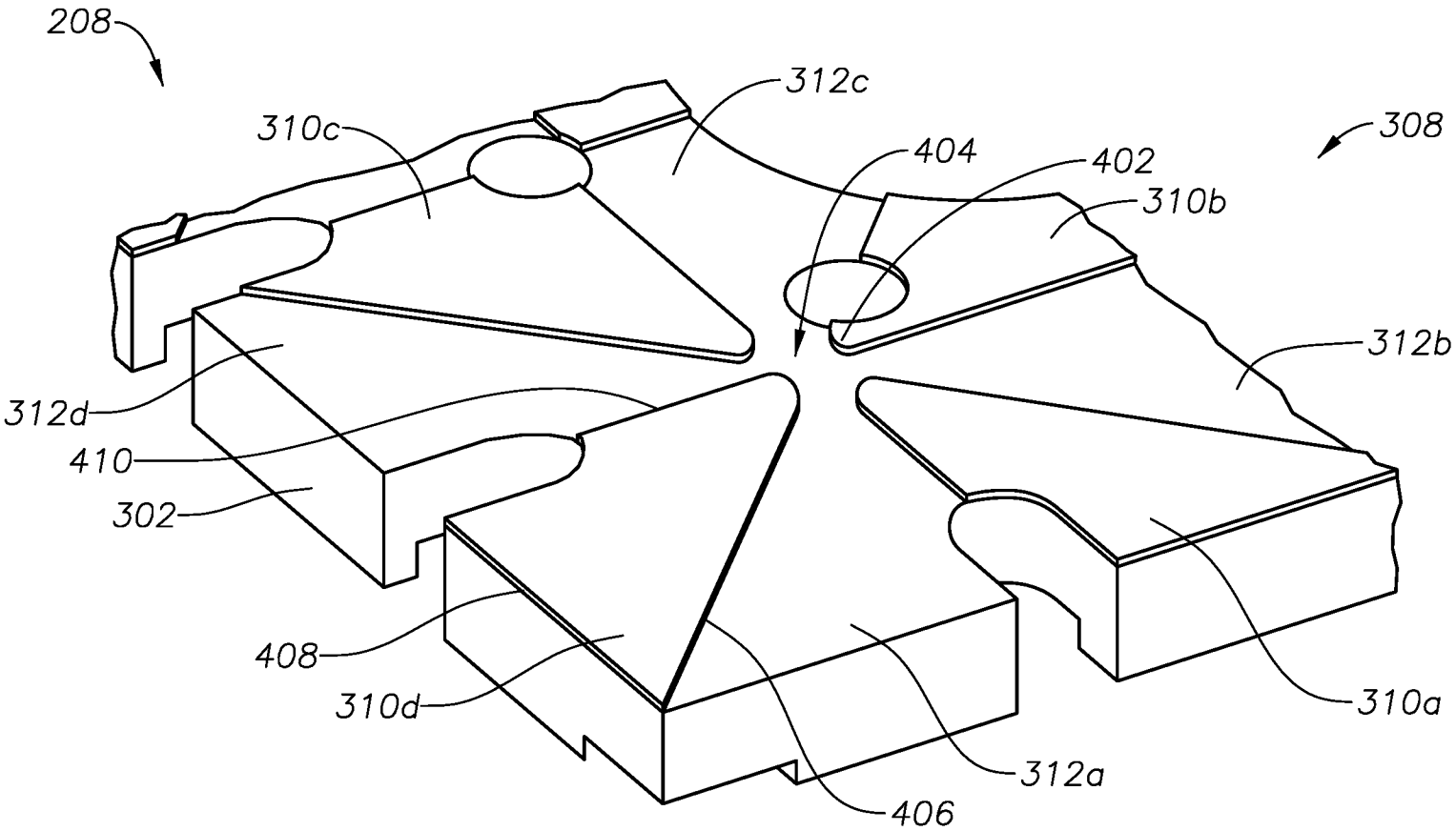
FIG. 4 illustrates an interlock section of the end fitting of FIG. 3.

FIG. 4 illustrates the interlock section 308 of the substrate 208. The interlock section 308 may include at least one projection 310 and/or at least one recess 312. For example, projections 310 may project from the substrate 208 and the recesses 312 may be at least partially formed by a surface of the substrate 208, i.e., the base of the recess 312 may be the same surface as that of the substrate 208. In some implementations, each recess 312 is dug, gouged, carved, etc. into the substrate 208 and each of the projections 310 is at least partially formed by a surface of the substrate 208.

Each projection 310 and each recess 312 may be triangular and may form a pinwheel type of pattern on the substrate 208. The pinwheel pattern is formed by multiple projections and multiple recesses. As illustrated in FIG. 4, four projections, a first projection 310*a*, a second projection 310*b*, a third projection 310*c* and a fourth projection 310*d* and four recesses, a first recess 312*a*, a second recess 312*b*, a third recess 312*c* and a fourth recess 312*d*, form the pinwheel pattern. A central vertex 402 of each projection may be at a central region 404 of the pinwheel pattern.

Each of the multiple projections has a shape substantially similar to a shape of the other projections in the interlock section. For example, each of the first projection 310*a*, second projection 310*b*, third projection, 310*c* and fourth projection 310*d* may have a respective hypotenuse, i.e., a first hypotenuse on the first projection, a second hypotenuse on the second projection, a third hypotenuse on the third projection and a fourth hypotenuse on the fourth projection.

Each projection 310 may include a substantially planar surface that is substantially parallel to the substrate 208. The substantially planar surface may be bound by a first edge 406, a second edge 408 and a third edge 410. It is not necessary for the projection to include a substantially planar surface between the first, second and third edges. Each edge may be a raised linear edge that projects from the substrate 208. It is not necessary that each of the first edge 406, the second edge 408 and third edge 410 connect with each other. A combination of partial raised first, second and third edges may form the projection.

The triangular shape of each projection 310 and each recess 312 may be the shape of a right triangle, i.e., a triangle in which an angle formed by two of the sides is ninety degrees. For example, the first edge 406 of the projection 310 may be a hypotenuse of the right triangle and the second edge 408 and the third edge 410 of the projection 310 may be legs that meet each other at a ninety degree angle.

A pinwheel pattern is not necessary. Fewer than all four projections may be used. Any one, two or three of the projections in their current configuration on the substrate may be used to join two interlock sections to each other. Any one, two or three of the recesses in their current configuration on the substrate may be used to join two interlock sections to each other.

Figure 5:
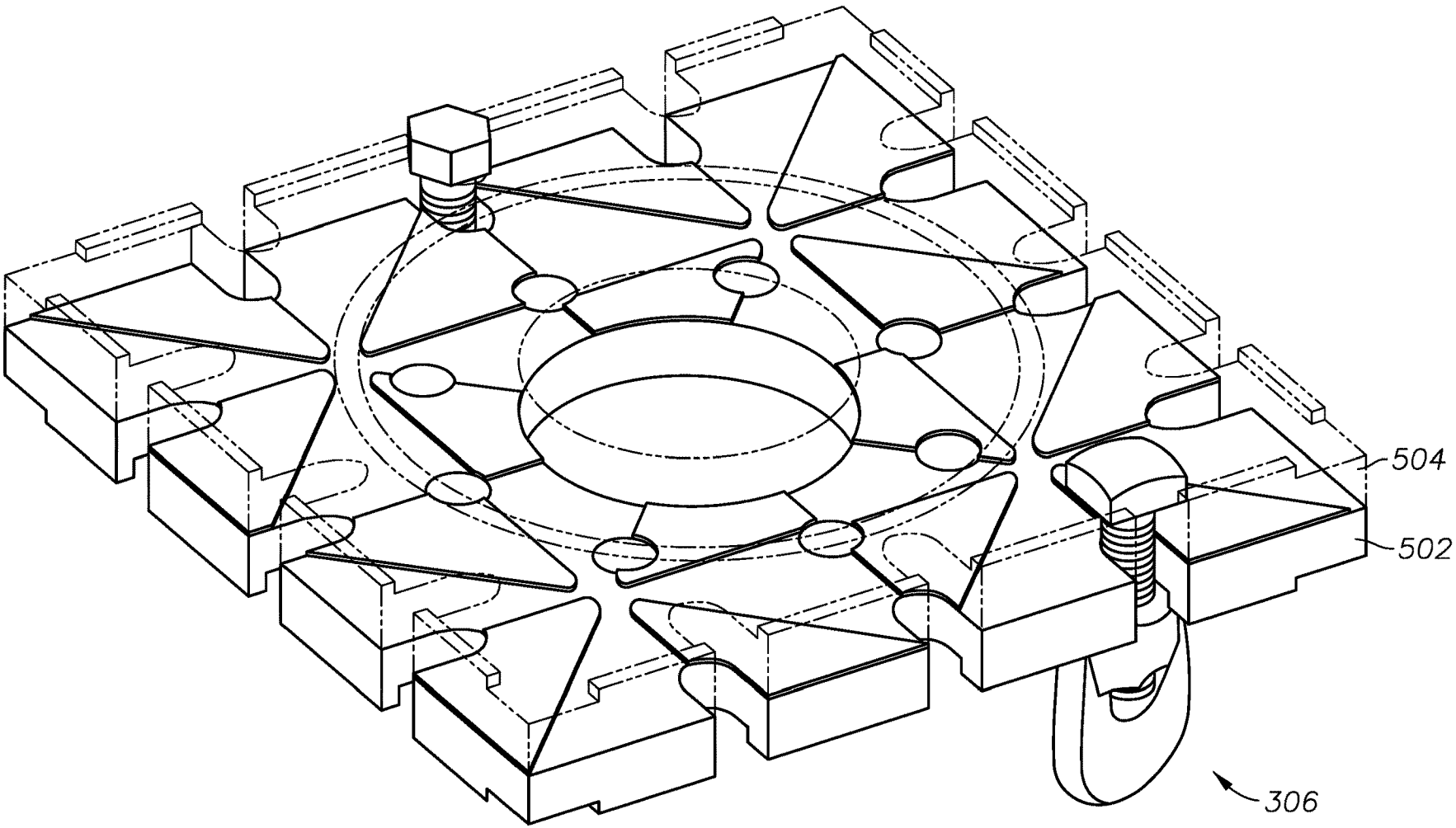
FIG. 5 illustrates a connection of two of the end fittings of FIG. 3.

FIG. 5 illustrates a first end fitting 502 and a second end fitting 504 connected to each other. At least one interlock section of the first end fitting 502 engages at least one interlock section of the second end fitting 502. Projections of the first end fitting 502 engage recesses of the second end fitting 504. Projections of the second end fitting 504 engage recesses of the first end fitting 502. Any of the projections of an interlock section of one end fitting may engage any of the recesses of an interlock section of an engaged end fitting. A first interlock section and a second interlock section may be negative impressions of each other when mated with each other.

The end fittings 502 and 504 may be held together by the fasteners 306. For example, a fastener may be rotatably attached to the edge recess 304 on end fitting 502 and engage an empty recess 304 on end fitting 504. It may be helpful that each fastener be attached to a left recess only (or attached to a right recess only) so that when end fitting 502 is attached to end fitting 504, each fastener 306 is guaranteed to engage an empty recess 304.

Each projection is ninety degrees apart from an adjacent projection. The first end fitting 502 may engage the second end fitting 504 in four configurations that are ninety degrees apart from each other. Engagement of projections and recesses prevents lateral motion between the first end fitting 502 and the second end fitting 504.

Some implementations may include a single material or a combination of materials. For example, the entire end fitting 104 may be made of a first particular material, e.g., aluminum. In some implementations, the substrate 208 may be made of a particular material, e.g., aluminum, and the remaining material may be a different material. In other implementations, some or all of the projections may be a particular material, e.g., aluminum, and the remaining material may be a different material. The material of the end fitting is not limited to soft metals such as aluminum and may include a harder material than aluminum. Other implementations may include a softer material than aluminum.

Figure 6C:
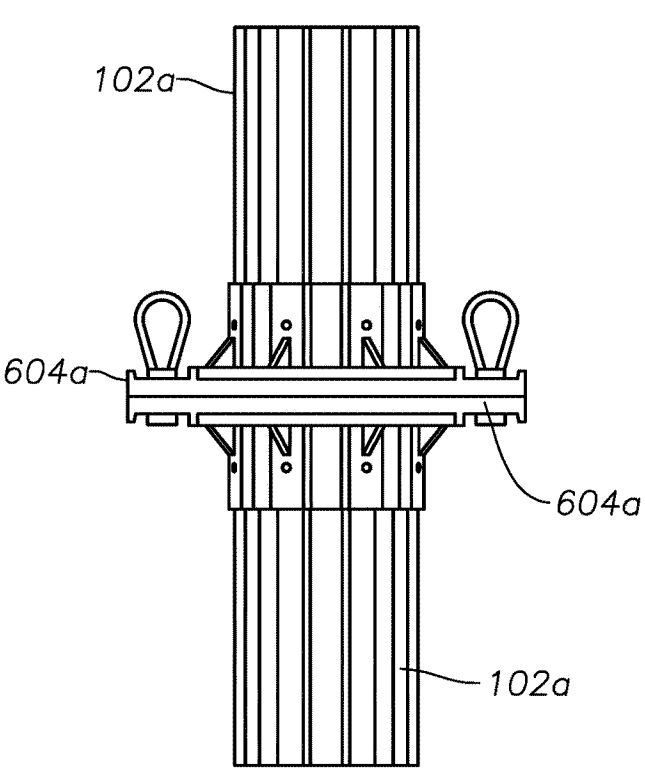
FIGS. 6*a*-6*c* illustrate three different configurations of attaching two end fittings to each other.
Figure 6B:
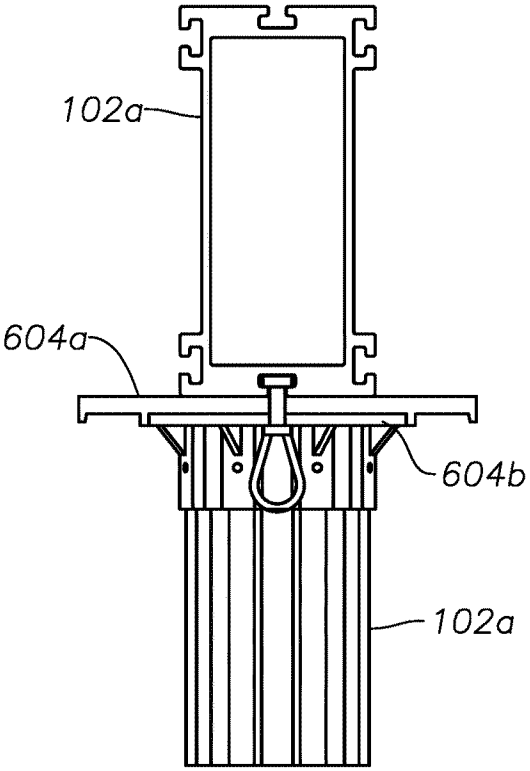
Figure 6A:
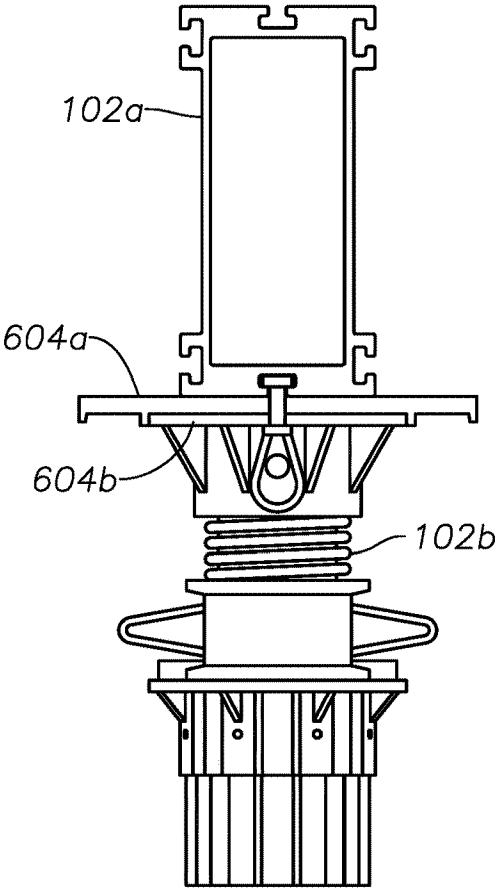

FIGS. 6*a*, 6*b* and 6*c* illustrate three different configurations of attaching two end fittings to each other. As shown in FIG. 6*a*, an end fitting may be attached to post 102*a* and adjustable screw leg 102*b*. As shown in FIGS. 6*a* and 6*b*, different sized end fittings 604*a* and 604*b* may engage each other on two opposing posts 102*a*. For example, a smaller end fitting, an end fitting having one interlock section, may engage a larger end fitting, an end fitting having five interlock sections. The smaller end fitting having one interlock section may engage a central interlock section of the larger end fitting having five interlock sections. As shown in FIG. 6*c*, two same sized end fittings 604*a* may be engage each other on substantially similar sized end fittings 604*a*.

Various implementations described herein may also be directed to a method of connecting two end fittings, which may include connecting the first interlock section of the first end fitting to the first interlock section of the second end fitting, disconnecting the first interlock section of the first end fitting from the first interlock section of the second end fitting, rotating the first end fitting any of ninety degrees, one hundred and eighty degrees and two hundred and seventy degrees, and reconnecting the first interlock section of the first end fitting to the first interlock section of the second end fitting.

In combination with the robust nature of the materials of the integrated construction system and the method of assembly, the cost to own the present integrated construction system is vastly reduced for both a dead asset basis, as well as the physical maintenance cost required to maintain a formwork and access inventory. In addition, the integrated construction system provides an increased flexibility to handle field applications, as well as increase the efficiency for the contractors that will use the integrated construction system to build concrete structures.

The discussion above is directed to certain specific implementations. It is to be understood that the discussion above is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An end fitting for a structural support member comprising:

a substrate having a first substantially planar surface; and a first interlock section on the substrate, wherein the first interlock section comprises:

a first projection projecting from the first substantially planar surface defined at least partially by a first edge, a second edge and a third edge coupled together in a right-triangle configuration;

wherein the first projection is adjacent to a first triangular recess on a first side thereof and a second triangular recess on a second side thereof.

2. The end fitting as recited in claim 1, further comprising:

at least one second projection in the first interlock section projecting from the first substantially planar surface.

3. The end fitting as recited in claim 2, wherein the first projection includes a first hypotenuse and the at least one second projection includes a second hypotenuse, the first hypotenuse being ninety degrees apart from the second hypotenuse about a center of the first substantially planer surface.

4. The end fitting as recited in claim 3, wherein the first interlock section includes a third projection having a third hypotenuse and a fourth projection having a fourth hypotenuse, the third hypotenuse being one hundred and eighty degrees apart from the first hypotenuse and the fourth hypotenuse being two hundred and seventy degrees apart from the first hypotenuse.

5. The end fitting as recited in claim 2, wherein each of the first projection and the at least one second projection includes a center vertex at a central region of the first interlock section.

6. The end fitting as recited in claim 1, further comprising:

at least one recess defined by the first edge or the second edge, the at least one recess having a right-triangle configuration, the first edge being a hypotenuse of the right-triangle configuration.

7. The end fitting as recited in claim 6, wherein the first substantially planar surface at least partially defines a base of the at least one recess.

8. The end fitting as recited in claim 1, further comprising a second interlock section, the second interlock section being positioned on the substrate in negative mirror symmetry with the first interlock section.

9. A structural support member end fitting system comprising:

a first end fitting and a second end fitting for a structural support member, the first and the second end fitting each comprising:

a substrate having a first substantially planar surface; and a first interlock section on the substrate, wherein the first interlock section includes a first projection projecting from the first substantially planar surface and defined at least partially by a first edge, a second edge and a third edge coupled together in a right-triangle configuration;

wherein the first projection is adjacent to a first triangular recess on a first side thereof and a second triangular recess on a second side thereof.

10. The structural support member end fitting system as recited in claim 9, wherein the first end fitting and the second end fitting include at least one second projection in the first interlock section projecting from the first substantially planar surface.

11. The structural support member end fitting system as recited in claim 10, wherein the first projection includes a first hypotenuse and the at least one second projection includes a second hypotenuse, the first hypotenuse being ninety degrees apart from the second hypotenuse about a center of the first substantially planer surface.

12. The structural support member end fitting system as recited in claim 11, wherein the first interlock section includes a third projection having a third hypotenuse and a fourth projection having a fourth hypotenuse, the third hypotenuse being one hundred and eighty degrees apart from the first hypotenuse and the fourth hypotenuse being two hundred and seventy degrees apart from the first hypotenuse.

13. The structural support member end fitting system as recited in claim 10, wherein each of the first projection and the at least one second projection includes a center vertex at a central region of the first interlock section.

14. The structural support member end fitting system as recited in claim 9, wherein the first end fitting and the second end fitting include at least one recess defined by the first edge or the second edge, the at least one recess having a right-triangle configuration, the first edge being a hypotenuse of the right-triangle configuration.

15. The structural support member end fitting system as recited in claim 14, wherein the first substantially planar surface is defined at least partially by a base of the at least one recess.

16. The structural support member end fitting system as recited in claim 9, further comprising a second interlock section, the second interlock section being positioned on the substrate in negative mirror symmetry with the first interlock section.

17. The structural support member end fitting system as recited in claim 9, wherein the first end fitting is configured to connect to the second end fitting in any of four positions, wherein each of the four positions is ninety degrees apart from an adjoining position.

18. A method of connecting end fittings comprising:

connecting a first interlock section of a first end fitting to a second interlock section of a second end fitting, each of the first and second interlock section having a first plurality of projections and recesses; and disconnecting the first interlock section from the second interlock section of the second end fitting;

rotating the first end fitting a first ninety degrees in a first direction; and reconnecting the first interlock section of the first end fitting to the second interlock section of the second end fitting;

wherein each of the projections and recess is triangular, and wherein each of the projections is adjacent to a first of the recesses on a first side thereof and a second of the recess on a second side thereof.

19. The method of claim 18, further comprising:

disconnecting the first interlock section from the second interlock section;

rotating the first end fitting a second ninety degrees in the first direction; and reconnecting the first interlock section to the second interlock section.

20. The method of claim 18, further comprising:

disconnecting the first interlock section from the second interlock section;

rotating the first end fitting a third ninety degrees in the first direction; and reconnecting the first interlock section to the second interlock section.

* * * * *